US006293765B1

(12) United States Patent
Peterson

(10) Patent No.: US 6,293,765 B1
(45) Date of Patent: Sep. 25, 2001

(54) TANDEM FIXED DISPLACEMENT PUMP WITH TORQUE CONTROL

(75) Inventor: Mark A. Peterson, Gilbert, IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/566,676

(22) Filed: May 8, 2000

(51) Int. Cl.[7] ..... F04B 23/04
(52) U.S. Cl. ..... 417/288; 417/324; 60/428
(58) Field of Search ..... 60/428, 468; 417/286, 417/287, 288, 324

(56) References Cited

U.S. PATENT DOCUMENTS 5,165,862 * 11/1992 Lindblom ..... 417/216
5,199,854 * 4/1993 Aoyama ..... 417/282
6,192,681 * 2/2001 Tsuruga et al. ..... 60/447

* cited by examiner

*Primary Examiner*—Charles G. Freay
(74) *Attorney, Agent, or Firm*—Zarley, McKee, Thomte, Voorhees & Sease

(57) ABSTRACT

A tandem fixed displacement pump circuit with torque control includes first and second pumps that draw fluid from a reservoir to supply respective load circuits, pressure relief valves for each of the load circuits, and a pilot operated sequence valve that monitors the pressure for each of the circuits and reduces the pressure of one of the circuits as the pressure in the other circuit rises. The sequence valve modulates to control the pressure in the secondary priority circuit so that a predetermined input torque value is not exceeded.

12 Claims, 2 Drawing Sheets

TANDEM FIXED DISPLACEMENT PUMP WITH TORQUE CONTROL

BACKGROUND OF THE INVENTION

The present invention relates to the field of hydraulics. More particularly, this invention relates to a tandem fixed displacement pump with a torque control circuit associated therewith.

Tandem fixed displacement pumps in general are well known in the hydraulic art. Tandem fixed displacement pumps can be useful in an open circuit arrangement where they supply pressurized fluid to two different load circuits while being driven by a single source of rotary power or driveline. For example, one of the pumps of a tandem fixed displacement pump can be used to operate the loader bucket (boom and tilt functions) on a small utility tractor or skid steer loader and the other pump can be used to operate various "high flow" attachments, including but not limited to road planers, brush cutters, or post hole augers.

Due to a variety of potentially constraining factors, including but not limited to engine size, couplings, and input shaft strength, there is a limited torque capacity available to the tandem fixed displacement pump. Problems can result when high pressure is demanded by both of the load circuits at the same time. Some means and method of coordinating the pressure requirements in each of the load circuits would be desirable to reduce the input torque required so that it does not exceed the maximum allowable torque.

Therefore, a primary objective of the present invention is the provision of a tandem fixed displacement pump with a torque control circuit that keeps the available torque capacity from being exceeded.

Another objective of this invention is the provision of a tandem fixed displacement pump system that provides priority pressure to a primary (high flow) load circuit and a secondary flow to a second load circuit when the available torque of the driveline permits.

Another objective of this invention is the provision of a tandem fixed displacement pump with torque control that is economical to manufacture, simple to adjust, reliable, and durable in use.

These and other objectives will be apparent from the drawings, as well as from the description and claims that follow.

SUMMARY OF THE INVENTION

The present invention relates to hydraulics, more particularly, a hydraulic circuit that includes a tandem fixed displacement pump used to supply fluid to a primary priority load circuit and a secondary priority load circuit. The tandem fixed displacement pump circuit with torque control includes first and second fixed displacement pumps that draw fluid from a reservoir to supply respective load circuits, pressure relief valves for each of the load circuits, and a pilot operated sequence valve that monitors the pressure for each of the circuits and reduces the pressure of one of the circuits as the pressure in the other circuit rises. The sequence valve modulates to control the pressure in the secondary priority circuit so that a predetermined input torque value is not exceeded.

DETAILED DESCRIPTION OF THE PREFERRED EMBODIMENT

Figure 1:
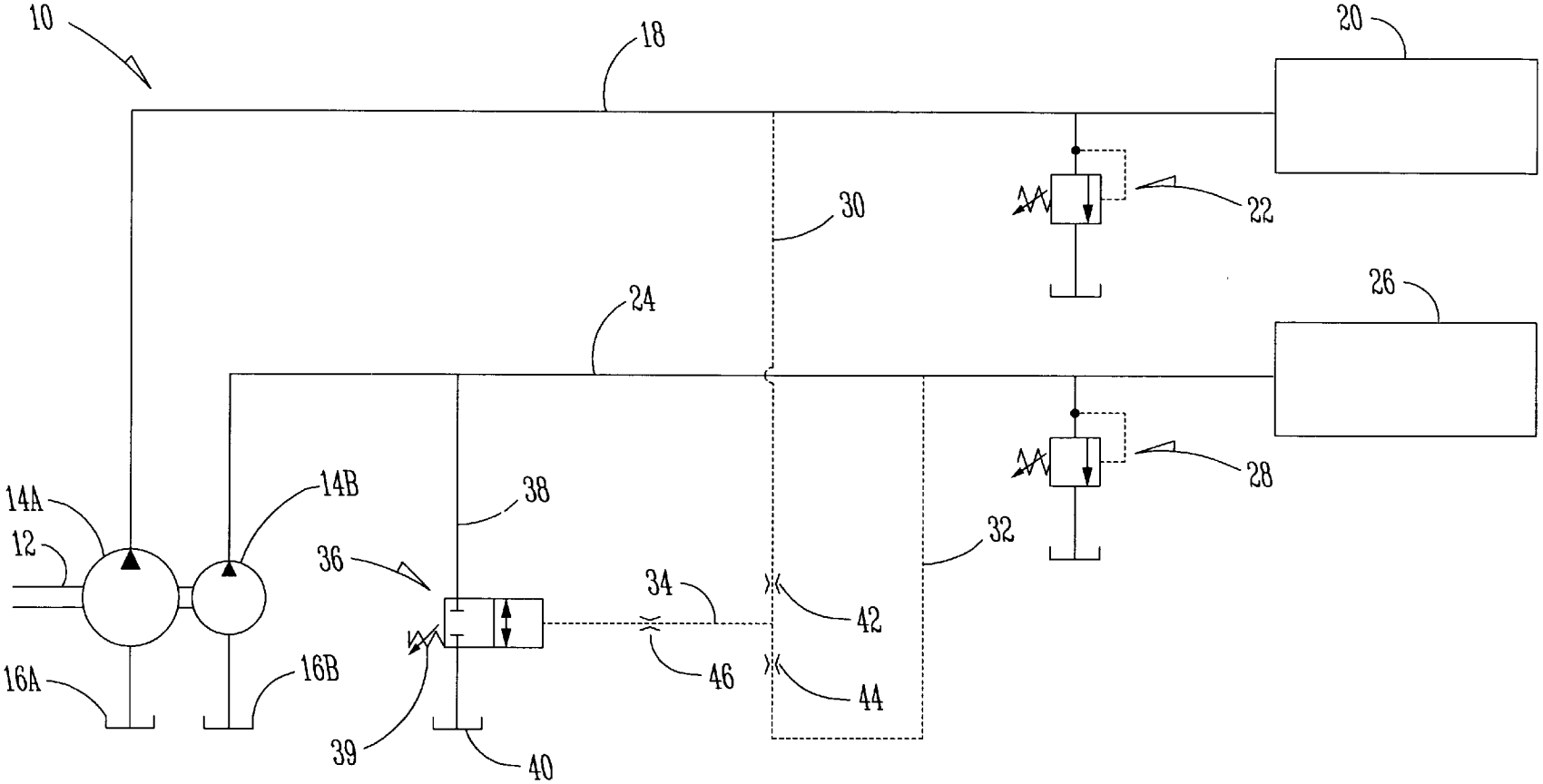
FIG. 1 is a hydraulic schematic depicting the present invention.

FIG. 1 shows a tandem fixed displacement pump circuit 10 according to this invention. An input shaft 12 powered by a conventional engine (not shown) drives a tandem fixed displacement pump 14. The tandem fixed displacement pump 14 includes a first gear pump 14A and a second gear pump 14B. The first and second pumps 14A, 14B have fixed volumetric displacements per revolution of the input shaft 12.

In the example shown in FIG. 1, the first pump 14A has a greater displacement than the second pump 14B. The first pump 14A connects to and draws hydraulic fluid from a tank or reservoir 16A. The pump 14A pressurizes the fluid and delivers it through a fluid passageway or hydraulic line 18 to a primary priority or high flow circuit control valve 20. In a small utility tractor or skid steer loader, the control valve 20 controls the attachments including but not limited to road planers, brush cutters, or post hole augers. An adjustable variable pressure relief valve 22 connects to the line 18 so as to adjustably limit the pressure of the fluid supplied to the control valve 20. As the attachments are operated, the pressure in the line 18 tends to rise.

The second pump 14B connects to and draws hydraulic fluid from a tank or reservoir 16B. The pump 14B pressurizes the fluid and delivers it through a fluid passageway or hydraulic line 24 to at least one secondary priority or low flow circuit control valve 26. In a skid steer loader or small utility tractor, the low flow circuit control valve(s) 26 operate the boom and tilt functions of the loader bucket. An adjustable variable pressure relief valve 28 connects to the line 24 so as to adjustably limit the pressure of the fluid supplied to the control valve 26. As the bucket is moved and loaded, the pressure in line 24 tends to increase. As is well known in the art, it is desirable to have check valves (not shown) in the secondary control valve 26 or the circuitry downstream of the valve 26 so that the bucket does not drop at low pressures.

A pilot line 30 connects to the line 18 upstream of the relief valve 22. A similar pilot line 32 connects to the line 24 upstream of the relief valve 28. The pilot lines 30 and 32, illustrated by dashed lines in FIG. 1, join at a line 34 (also dashed) that is operatively connected to one end of a sequence valve 36.

The sequence valve 36 is also connected to line 24 upstream of both the relief valve 28 and pilot line 32 by a fluid passageway or line 38. The valve 36 is a normally closed, two-position, two-port valve that is urged closed by a spring 39 whose force is adjustable in a conventional manner. The valve 36 has a first or closed position in which the flow of fluid from the second pump 14B through the line 38 to a tank or reservoir 40 is blocked. In the closed position (on the left in FIG. 1), fluid also cannot flow to the tank 40 from the pilot lines 30, 32, 34. The valve 36 has a second position (on the right in FIG. 1) in which fluid can flow through the valve 36 to the tank 40 when the pressure in the pilot line 34 acting on the valve 36 exceeds the opposing spring force exerted by the spring 39.

Orifices 42 and 44 are provided in the lines 30, 32 respectively to ensure pressure drops in the lines. Preferably the diameters of the orifices 42, 44 are equal, thus the pressure seen in line 34 is an average of the pressures in lines 30 and 32. An optional damping orifice 46 is also provided in the third pilot line 34 between the sequence valve 36 and the junction of the first and second pilot lines 30, 32. Preferably the orifices 42, 44, 46 are fixed orifices. The particular diameter of the orifices 42, 44, 46 can be selected to give the desired response characteristics.

In one example found to work well on a rubber tracked loader, 0.025 inch was selected as the diameter of orifices 42, 44, relief valves 22, 28 were set at 3400 psig, and the sequence valve was designed to open at 2200 psig at 1500 rpm engine speed and 2375 at 2500 rpm. A 0.030-inch diameter damping orifice 46 was used.

Figure 2:
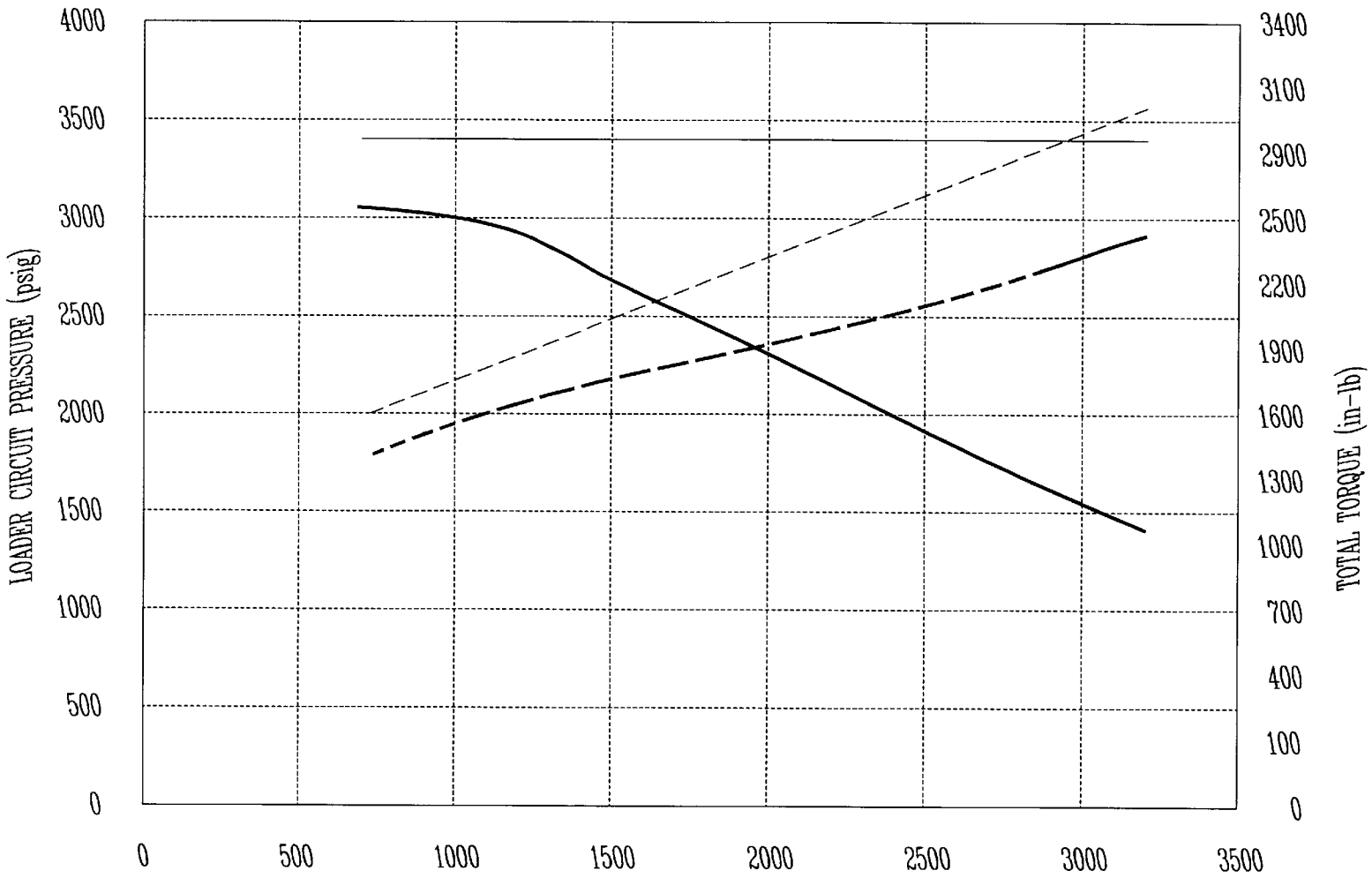
FIG. 2 is a graph showing loader pressure and input torque required by the fixed displacement pump as a function of primary or high flow pressure, both with and without this invention.

In operation, FIG. 2 shows the results both with and without the invention on the rubber tracked loader discussed above. Refer to the legend on FIG. 2. The maximum torque available under any condition is 2400 in-lb. With the invention, the pressure in the secondary priority or low flow loader circuit is reduced when the primary priority or high flow circuit pressure increases, so that the total torque to drive both pumps 14A, 14B is limited to the predetermined level. When the high flow circuit is at low pressure, the loader pressure is allowed to go to the higher, normal setting of the relief valve 28. The pilot pressure operated sequence valve 36 accomplishes the pressure reduction. Because the orifices 42, 44 are of equal size, the sequence valve 36 is piloted by the average of the pressures in the outlet lines 28, 24 of the two fixed displacement pumps 14A, 14B, respectively.

The invention gives a lower loader pressure as the high flow pressure increases, thus limiting the total input torque required. The slope of the resulting input torque curve is low, making the curve relatively flat or slowly rising. The input torque stays below the predetermined level for the entire operating range of high flow pressure. This represents a significant improvement over the typical results achieved in a conventional rubber tracked loader without the invention. See FIG. 2. Without the pilot operated sequence valve 36 and the associated lines and orifices, the torque demanded quickly exceeds the maximum torque available. The input torque exceeds 2400 in-lbs. after only about 2100 psig of high flow pressure in the graph of FIG. 2. Excess torque beyond this point can break input shafts or couplings and could conceivably stall smaller engines.

Thus, it can be seen that the present invention at least accomplishes its stated objectives.

One skilled in the art will appreciate that a common tank or reservoir can be used for the tanks or reservoirs 16A, 16B, and 40 without detracting from the invention.

Although a gear pump has been discussed in the above description of the preferred embodiment, other types of fixed displacement pumps, including those with gerotors or vanes, would suffice for this invention.

In the drawings and specification, there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A tandem pump circuit comprising:

a high flow load valve;

at least one low flow load valve;

a reservoir for holding hydraulic fluid;

a first pump including an input shaft and a first fixed displacement pumping mechanism connected to the input shaft for drawing fluid from the reservoir and pumping the fluid toward the high flow load valve through an output line;

a first pressure relief valve connected to the output line and having a predetermined pressure relief setting;

a second pump driven by the input shaft and including a second fixed displacement pumping mechanism connected to the input shaft for drawing fluid from the reservoir and pumping the fluid toward the at least one low flow load valve through an output line;

a second pressure relief valve connected to the output line of the second pump and having a predetermined pressure relief setting;

a first pilot pressure line fluidly connected to the output line of the first pump upstream from the first relief valve;

a second pilot pressure line fluidly connected to the output line of the second pump upstream of the second relief valve;

the first and second pilot pressure lines being joined together to form a third pilot pressure line;

the first pilot pressure line having an orifice therein, the second pilot pressure line having an orifice therein;

a normally closed pressure sequence valve fluidly connected to the third pilot line and to the output line of the second pump upstream of both the second relief valve and the second pilot line, the sequence valve including a first position in which flow from output line of the second pump to the reservoir is blocked and a second position in which flow from the second pump is drained through the sequence valve to the reservoir;

the third pilot line being connected to the sequence valve so as to urge the sequence valve to an open position when pressure in the third pilot line is greater than a predetermined value, the predetermined value being less than the predetermined pressure setting of the second relief valve;

whereby the sequence valve reduces the pressure in the output line of the second pump when the pressure in the output line of the first pump increases, such that a predetermined maximum input torque for both the first pump and the second pump combined is not exceeded.

2. The circuit of claim 1 wherein the first and second pumps are gear pumps.

3. The circuit of claim 1 wherein the first and second relief valves each include an adjustable spring so as to define adjustable pressure relief valves, each having a respective pressure setting.

4. The circuit of claim 1 wherein the pressure setting of the first relief valve is approximately equal to the pressure setting of the second relief valve.

5. The circuit of claim 1 wherein the orifice in the first pilot pressure line is a fixed orifice.

6. The circuit of claim 1 wherein the second pilot pressure line in the orifice is a fixed orifice.

7. The circuit of claim 1 wherein the third pilot line includes a damping orifice therein between the sequence valve and the joining of the first and second pilot lines.

8. The circuit of claim 1 wherein the sequence valve is a two-position two-port valve including a spring urging the valve into the first or closed position.

9. The circuit of claim 1 wherein the spring of the sequence valve is an adjustable spring.

10. The circuit of claim 1 wherein the first pilot line and the second pilot line have fixed orfices with diameters that are equal.

11. The circuit of claim 1 wherein the first pump has a fixed displacement and the second pump has a fixed displacement that is less than the displacement of the first pump.

12. A tandem pump circuit comprising:

a high flow circuit control valve;

at least one low flow circuit control valve;

a reservoir for holding hydraulic fluid;

a first pump including a first displacement pumping mechanism for drawing fluid from the reservoir and pumping the fluid toward the high flow circuit control valve through an output line;

a second pump coupled to the first pump and including a second fixed displacement pumping mechanism for drawing fluid from the reservoir and pumping the fluid toward the at least one low flow circuit control valve through an output line;

a first pilot pressure line fluidly connected to the output line of the first pump;

a second pilot pressure line fluidly connected to the output line of the second pump;

the first and second pilot pressure lines being joined together at a junction to form a third pilot pressure line;

the first pilot pressure line having an orifice therein; the second pilot pressure line having an orifice therein;

a normally closed pressure sequence valve fluidly connected to the third pilot line and to the output line of the second pump upstream of the second pilot line, the sequence valve including a first position in which flow from output line of the second pump to the reservoir is blocked and a second position in which flow from the second pump is drained through the sequence valve to the reservoir;

the third pilot line being connected to the sequence valve so as to urge the sequence valve to an open position when pressure in the third pilot line is greater than a predetermined value;

whereby the sequence valve reduces pressure in the output line of the second pump when pressure in the output line of the first pump increases, such that a predetermined maximum input torque for both the first pump and the second pump combined is not exceeded.

* * * * *